US005240121A

United States Patent [19]

Mead

[11] Patent Number: 5,240,121

[45] Date of Patent: Aug. 31, 1993

[54] HOLDER FOR POOL BALL RACK

[76] Inventor: Ronald L. Mead, 704 La Cumbre Cir., Corona, Calif. 91719

[21] Appl. No.: 937,116

[22] Filed: Aug. 31, 1992

[51] Int. Cl.[5] ..... A47F 5/00

[52] U.S. Cl. ..... 211/13; 211/87; 248/176; 273/14

[58] Field of Search ..... 211/13, 14, 87, 90; 248/176; 273/2, 14, 22, 18

[56] References Cited

U.S. PATENT DOCUMENTS 3,794,319 2/1974 Miller ..... 273/22
3,929,333 12/1975 Kremski ..... 273/22
4,591,051 5/1986 Lowman ..... 273/22 X

*Primary Examiner*—Robert W. Gibson, Jr.
*Attorney, Agent, or Firm*—Roger A. Marrs

[57] ABSTRACT

A triangular shaped holder is disclosed herein for removably retaining a pool ball rack on a wall which includes a base member having a back adjacent the wall for accommodating mounting fasteners. A mounting member is integrally carried on the front of the base member and is of reduced dimension so as to receive placement of the rack thereover. The base member includes a shoulder against which the rack abuts to indicate the storage position of the rack. The holder further includes several shelves extending transversely across the open cavity of the holder with surface recesses for supporting accessories to be stored employed in the game of pool.

3 Claims, 1 Drawing Sheet

FIG. 1.
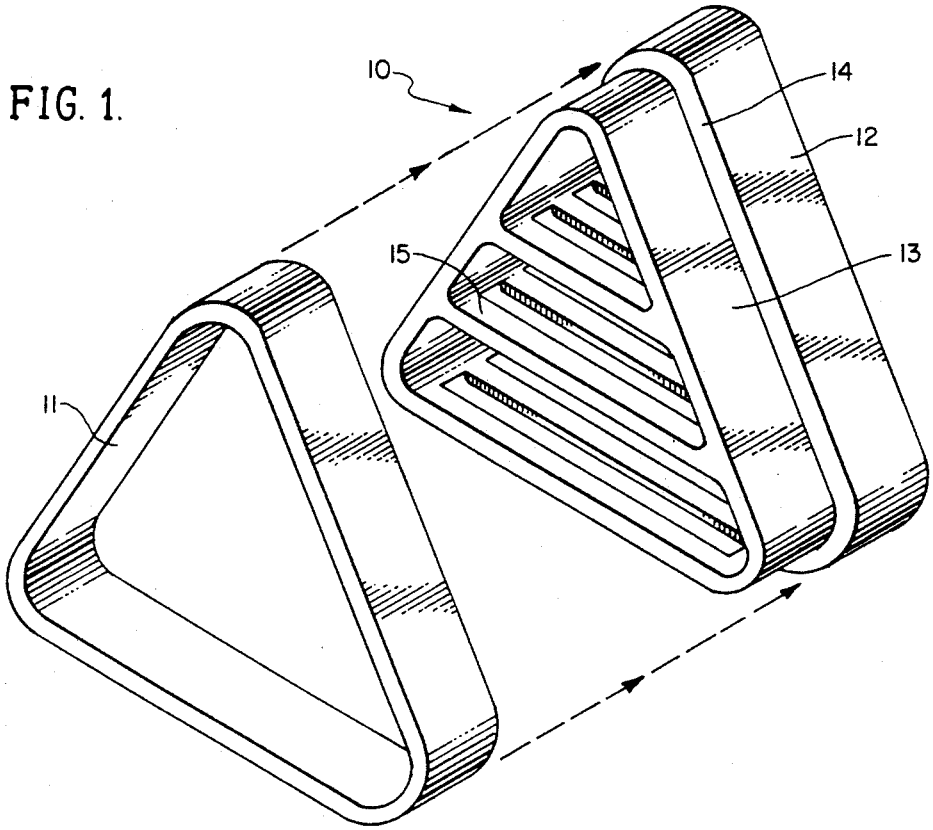
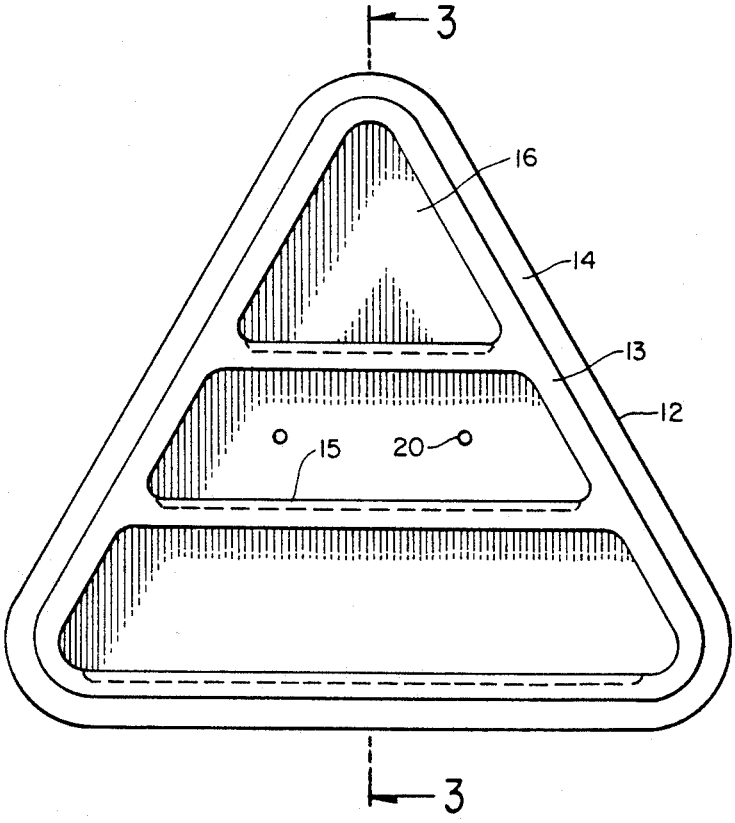
FIG. 2.
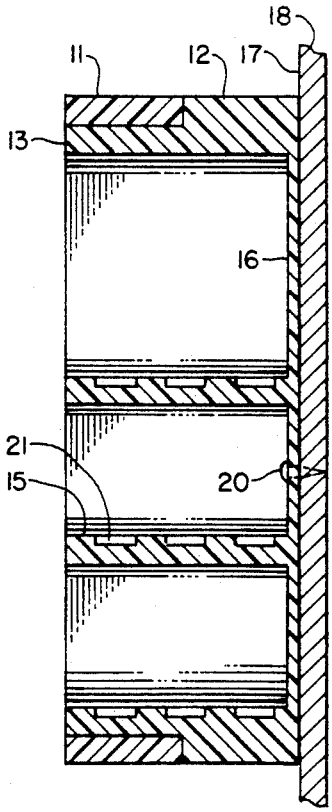
FIG. 3.

HOLDER FOR POOL BALL RACK

BACKGROUND OF THE INVENTION

1. Field of the Invention

The present invention relates to the field of holders, and more particularly to a holder for supporting a triangular shaped pool back rack from the surface of a wall, as well as supporting accessory items used in the game of pool.

2. Brief Description of the Prior Art

During the play of a game of pool, it is customary for the players to initiate a game by placing a plurality of pool balls within the open cavity of a triangular rack and positioning the balls on the surface of the pool table by moving the rack from place to place. Once the ball position has been located, the rack is removed and is generally placed on the edge of the pool table, placed on a chair nearby, or placed on a nearby table which is not being used. In some instances, wall pegs used in supporting coats or hats are sometimes used and, in another instances, pegs on a coat or hat tree are employed.

Difficulties and problems have been encountered when temporarily storing a pool back rack in this manner, which stem largely from the fact that the rack is never in the same place so that it is difficult to locate for future games and, in other instances, the rack ends up on the floor where it is stepped upon and broken. Also, other accessories used in the game of pool, such as chalk for the pool stick tips and brushes, are seldom stored in the same place and, again, such items are lost, broken or misplaced so they are not available for future use.

Therefore, a long-standing need has existed to provide a storage means, such as a holder, that will readily support the triangular pool ball rack as well as other accessories so that these items are convenient for the use of the players during a game procedure. Such a means must provide for temporary storage and must provide for ready access by the users so that they may place the items into the holder and remove the items therefrom.

SUMMARY OF THE INVENTION

Accordingly, the above problems and difficulties are obviated by the present invention which provides a novel holding means for releasably retaining a triangular shaped pool ball rack as well as a plurality of other accessories used in the game of pool. In one form of the invention, the holder includes a base member of triangular configuration about its external periphery and which includes a backing adapted to rest against the exterior surface of a wall for wall-mounting purposes. Fastening means are provided for securing the base member via the back directly to the wall. The base member is further provided with a triangular support member which is of reduced exterior dimension outwardly projecting in a cantilevered fashion from the base member which is adapted to insertably receive the pool ball rack by occupying the cavity of the rack so that the rack fits over the triangular support portion for storage purposes. A shoulder means carried on the base member serves as a stop against which the edge of the pool ball rack abuts. Preferably, the thickness of the shoulder is substantially equal to the thickness of the rack so that when the rack is in its storage position, the external surface of the rack is coextensive with the external surface of the base member.

The holder further includes several shelves which extend across the interior of the base member immediately ahead of the back so that a variety of accessories used in the game of pool may be stored thereon.

Therefore, it is among the primary objects of the present invention to provide a novel holder for a pool ball rack which will hold not only the rack but accessory items so that the rack and the items are available to players during the course of play.

Another object of the present invention is to provide a novel holder for a pool ball rack which includes a triangular portion adapted to receive the rack thereover and which is conformal in shape and size to the cavity of the rack for support purposes.

Yet another object of the present invention is to provide a novel holder for supporting a triangular rack wherein the holder includes a triangular mounting member over which the rack is placed in conformal relationship and which further includes a plurality of shelves for supporting accessory items used in the game of pool.

Still a further object of the present invention is to provide a novel means which is convenient for the players of pool to store a pool ball rack and other accessory items so that the rack and items are in a safe storage location accessible to the players and are not randomly stored in a variety of inconvenient locations.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is an exploded perspective view of the novel holder incorporating the present invention;

FIG. 2 is a front elevational view of the novel holder shown in FIG. 1; and FIG. 3 is a transverse cross-sectional view of the rack holder shown in FIG. 2 as taken in the direction of arrows 3—3 thereof.

DESCRIPTION OF THE PREFERRED EMBODIMENT

Referring to FIG. 1, the novel holder of the present invention is indicated in the general direction of arrow 10 and is further illustrated in a preparatory position for receiving a pool ball rack, indicated by numeral 11. As is the conventional practice, the pool ball rack is of triangular configuration in elevational view which includes three sides connected together at their respective adjacent ends so as to define a triangular cavity between the inner surface of the sides.

The holder 10 includes a base member 12 which is also of triangular configuration. Immmediately ahead or forward of the base member 12 there is provided a triangular mounting or support member 13 which is of reduced external dimension so as to fit into the open cavity of the rack 11. The base member 12 further includes a triangular shoulder 14 against which the end of rack 11 abuts when the support member 13 is introduced into the cavity of the rack. The holder 10 further includes a plurality of shelves, such as mid shelf 15 useful in storing a plurality of accessories used in the game of pool. Such accessories may take the form of chalk, brushes or the like.

Referring now in detail to FIGS. 2 and 3, it can be seen that the holder further includes a back 16 which may be placed against the exterior surface 17 of a wall 18. A pair of fasteners 20 may be employed for securing the holder to the wall surface. FIG. 2 illustrates that the base member 12 and the mounting or support member 13 include external surfaces which are conformal in a triangular configuration. It can also be seen that the external surface of the mounting or support member 13 is of reduced dimension so that shoulder 14 is exposed above the support member 13. Therefore, the base member 12 and the support member 13 may be said to be symmetrical in front elevational view although the support member 13 is of reduced exterior dimension.

FIG. 3 further illustrates that the shelves, such as shelf 15, may include elongated recesses, such as identified by numeral 21, for receiving accessory items used in the game of pool. These recesses are open so that item may be placed readily on the shelves and will not not fall from the shelves. Furthermore, it can be seen that once the rack 11 has been mounted on the mounting or support member 13, its external surface is coextensive with the external surface of the base member 12.

Therefore, it can be seen that the holder of the present invention provides a novel means for removably supporting a pool ball rack and other accessory items. The holder may be mounted directly to the front surface of a wall where it is secured by fasteners and that when so mounted, the mounting or support member 13 is available to receive the rack 11 by inserting the member 13 into the open cavity of the rack so that the rack can be supported thereon. The rack will proceed over member 13 until its edge abuts against the shoulder 14 of the base member 12 at which time the user will know that the rack can be adequately supported thereon.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A holder for a triangular pool ball rack comprising:

a triangular base member;

a triangular support member carried on said base member and of reduced dimension;

said support member cantilevered outwardly from one side of said base member and in symmetry therewith;

a back on said base member for mounting said base member flush with a vertical wall surface;

shelves extending transversely across said base member and said support member; and said support member adapted to be inserted into the cavity of the pool ball rack.

2. The invention as defined in claim 1 wherein:

said base member includes a triangular shoulder in front elevation surrounding said triangular support member and adapted to abutting engagement with the pool ball rack.

3. The invention as defined in claim 2 including:

said shelves having open recesses for receiving items associated with the game of pool.

* * * * *